US008534444B2

(12) United States Patent
Senger

(10) Patent No.: US 8,534,444 B2
(45) Date of Patent: Sep. 17, 2013

(54) ESCALATOR DUAL SOLENOID MAIN DRIVE SHAFT BRAKE

(75) Inventor: Alois Senger, Gresten (AT)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 13/320,957

(22) PCT Filed: Jun. 16, 2009

(86) PCT No.: PCT/US2009/047496

§ 371 (c)(1), (2), (4) Date: Nov. 17, 2011

(87) PCT Pub. No.: WO2010/147579

PCT Pub. Date: Dec. 23, 2010

(65) Prior Publication Data

US 2012/0073933 A1 Mar. 29, 2012

(51) Int. Cl.
*B66B 25/00* (2006.01)

(52) U.S. Cl.
USPC ..... 198/323

(58) Field of Classification Search
USPC ..... 198/323, 330
See application file for complete search history.

(56) References Cited

U.S. PATENT DOCUMENTS

| | | | | | |
|---|---|---|---|---|---|
| 1,659,968 | A | * | 2/1928 | Woodward | 198/810.02 |
| 2,088,460 | A | * | 7/1937 | Bouton | 198/323 |
| 2,259,366 | A | * | 10/1941 | Dunlop | 198/323 |
| 2,460,017 | A | * | 1/1949 | Lautrup et al. | 188/69 |
| 2,695,094 | A | * | 11/1954 | Riley | 198/323 |
| 3,017,963 | A | * | 1/1962 | Landschulze | 188/82.34 |
| 3,469,678 | A | * | 9/1969 | Dube et al. | 198/323 |
| 3,913,723 | A | * | 10/1975 | Johnson | 198/323 |
| 3,927,738 | A | * | 12/1975 | Ernst | 188/187 |
| 4,508,205 | A | * | 4/1985 | Aulagner et al. | 198/323 |
| 4,875,558 | A | | 10/1989 | Berkhan et al. | |
| 4,927,136 | A | | 5/1990 | Leask | |
| 5,337,878 | A | * | 8/1994 | Mehlert et al. | 198/323 |
| 6,247,575 | B1 | | 6/2001 | Thiel | |
| 6,273,234 | B1 | * | 8/2001 | Balzer-Apke et al. | 198/323 |
| 6,520,300 | B2 | | 2/2003 | Balzer-Apke et al. | |
| 6,997,302 | B2 | | 2/2006 | Fargo et al. | |
| 7,168,547 | B2 | | 1/2007 | Thaler et al. | |
| 7,950,514 | B1 | * | 5/2011 | Nurnberg et al. | 198/323 |
| 2008/0314694 | A1 | | 12/2008 | Park | |

FOREIGN PATENT DOCUMENTS

| | | | |
|---|---|---|---|
| GB | 2 207 718 | A | 2/1989 |
| JP | 60-006778 | U | 1/1985 |
| JP | 2000095469 | A | 4/2000 |
| JP | 2008013344 | A | 1/2008 |
| WO | WO 2004/071860 | A | 8/2004 |

OTHER PUBLICATIONS

International Search Report and Written Opinion for Application Serial No. PCT/US2009/047496.

* cited by examiner

*Primary Examiner* — Gene Crawford
*Assistant Examiner* — Keith R Campbell
(74) *Attorney, Agent, or Firm* — Kinney & Lange, P.A.

(57) ABSTRACT

A main drive shaft brake for a passenger conveyor includes a braking element, an actuator, and a counter-actuator. The actuator is de-energized to release the braking element and halt operation of the passenger conveyor during an abnormal or emergency condition. An energized counter-actuator permits release of the braking element but, when de-energized, inhibits release of the braking element by the actuator to prevent unintentional release of the braking element caused by, for example, an accidental loss of power to the actuator.

24 Claims, 4 Drawing Sheets

ESCALATOR DUAL SOLENOID MAIN DRIVE SHAFT BRAKE

BACKGROUND

The present invention relates to braking systems for passenger conveyors. More particularly, the present invention relates to main drive shaft brakes used to halt passenger conveyors in the event of an emergency or otherwise abnormal condition.

Conventional passenger conveyors, such as moving walkways or escalators, include a series of pallets or steps that move in a closed loop. Passenger conveyors allow people to stand or walk along the steps while being transported across a distance. The steps are typically attached to a step chain, which provides forward movement to the steps. More specifically, a drive sheave imparts motion to step chains thereby moving the steps, and any people located on the steps, along a predetermined track. For escalators, the track extends between a lower elevation and a higher elevation and back to the lower elevation in a closed loop. Moving walkways can have inclined, declined, or substantially flat tracks and sometimes include a pair of oppositely traveling, parallel walkways.

For some reasons passenger conveyors include both a machine brake and a main drive shaft brake. The machine brake is activated to prevent further movement of the step chain under normal conditions. For example, if the passenger conveyor is shut down for the evening or if repairs are needed, the machine brake will stop the step chain and hold the passenger steps in a stationary condition. The main drive shaft brake, or "auxiliary brake" as it is sometimes referred to, is an additional braking system that can be activated to halt movement of the step chain to avoid damage to the passenger conveyor and/or prevent passenger injury.

SUMMARY

An embodiment of the present invention is a main drive shaft brake for a passenger conveyor. The main drive shaft brake includes a braking element, an actuator, and a counter-actuator. The braking element halts movement of the driving mechanism in the passenger conveyor system. The actuator is connected to the braking element and controls activation of the braking element. The actuator is movable between an energized mode, in which power supplied to the actuator keeps the braking element in a ready position, and an un-energized mode, in which a lack of power supplied to the actuator causes the actuator to release the braking element, thereby halting movement of the driving mechanism in the passenger conveyor system. The counter-actuator is connected to the actuator. The counter-actuator is movable between an energized mode in which power supplied to the counter-actuator keeps the counter-actuator from interfering with the actuator, and an un-energized mode, in which a lack of power causes the counter-actuator to block the release of the braking element.

In another embodiment, the main drive shaft brake includes a braking element, a release lever, an actuator, and a counter-actuator. The release lever is connected to the braking element for holding the braking element in a lifted and ready position or releasing the braking element to halt movement of the conveyor. The actuator has a first coil adjacent to the release lever and a first stroke extending into the first coil. The first stroke is capable of moving further into the first coil to enable the release lever to release the braking element. The counter-actuator is opposite to the actuator. The counter-actuator has a second coil and a second stroke extending into the second coil. The second stroke is biased by a spring such that a loss of power causes the second stroke to block the first stroke from moving further into the first coil, thereby preventing release of the braking element.

Another embodiment of the present invention is a method of controlling a main drive shaft brake for a passenger conveyor. The method includes controlling a brake actuator in either an energized state, such that the brake actuator holds the main drive shaft brake in lifted position, or a de-energized state to cause the brake actuator to release the main drive shaft brake to a dropped position. The method also includes inhibiting the brake actuator from releasing the main drive shaft brake in response to a loss of line power.

Another embodiment of the present invention is a passenger conveyor including a driving mechanism, a drive sheave, and a main drive shaft brake. The drive sheave is in contact with the driving mechanism for imparting motion thereto. The main drive shaft brake is associated with the drive sheave. The main drive shaft brake including a braking element for halting rotation of the drive sheave, an actuator for controlling activation of the braking element, and a counter-actuator for blocking an unintentional activation of the braking element.

DETAILED DESCRIPTION

Figure 1:
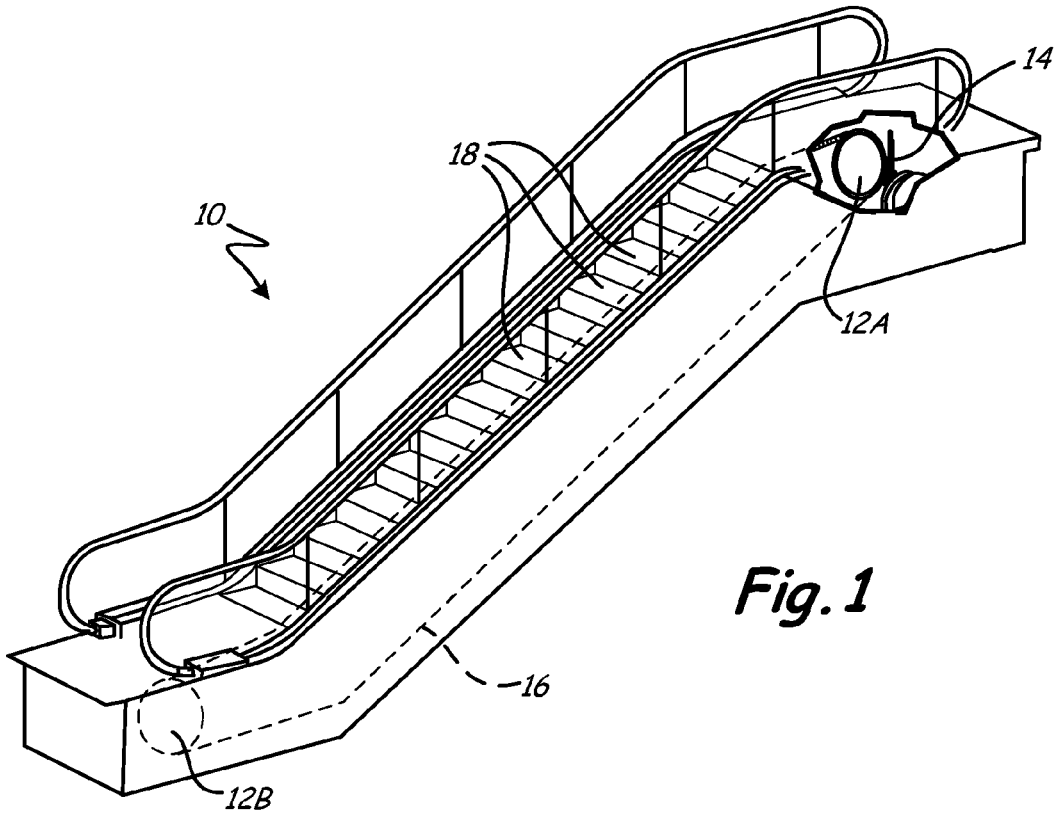
FIG. 1 is a perspective view of a passenger conveyor with a portion shown in phantom to show a driving sheave applied to a main drive shaft brake in accordance with the present invention.

FIG. 1 is a perspective view of passenger conveyor 10 with a portion shown in broken lines to show drive sheave 12A having auxiliary braking system or main drive shaft brake 14. Depicted in FIG. 1 are passenger conveyor 10, drive sheave 12A, guide sheave 12B, main drive shaft brake 14, step chain 16, and steps 18. Drive sheave 12A imparts forward motion to step chain 16, which propels steps 18 of passenger conveyor 10 along a closed loop. If an emergency condition or otherwise abnormal situation should occur, main drive shaft brake 14 halts down motion of passenger conveyor 10 by directly stopping movement of drive sheave 12A.

In the depicted embodiment, passenger conveyor 10 is an escalator having drive sheave 12A and guide sheave 12B. Drive sheave 12A is located in an upper landing of passenger conveyor 10 and is connected to a motor. Guide sheave 12B is located in a lower landing of passenger conveyor 10 and is not directly associated with a motor. Main drive shaft brake 14 is located adjacent and connected to drive sheave 12A in the upper landing. Step chain 16 extends around an outer surface of both drive sheave 12A and guide sheave 12B to form a closed loop extending from the upper landing to the lower landing. Sheave 12A has teeth or sprockets that match the chain links of step chain 16 and provide for secure engagement of step chain 16. A plurality of steps 18 have a top surface for carrying passengers and a bottom surface connected to step chain 16 for propulsion along with step chain 16 around the closed loop. Although passenger conveyor 10 is illustrated as an escalator, main drive shaft brake 14 is not so limited and is appropriate for other systems such as, but not limited to, moving walkways.

During normal operation of passenger conveyor 10, drive sheave 12A rotates and engages step chain 16. The forward motion imparted to step chain 16 propels step chain 16, as well as steps 18, between the upper landing and the lower landing. Steps 18 travel in a closed loop between the upper landing and the lower landing. When located above step chain 16, and moving in the selected direction of travel, steps 18 carry passengers either up or down passenger conveyor 10. When located beneath step chain 16, or otherwise not exposed for use by passengers and moving in a return direction between the upper and lower landings, steps 18 are free of passengers and simply return to the beginning of the loop on the passenger side. If an abnormal condition occurs, such as over-speed or an unintentional reversal in direction, main drive shaft brake 14 is activated. Actuation of main drive shaft brake 14 halts downward movement of drive sheave 12A, thereby stopping movement of step chain 16 and steps 18.

Figure 2:
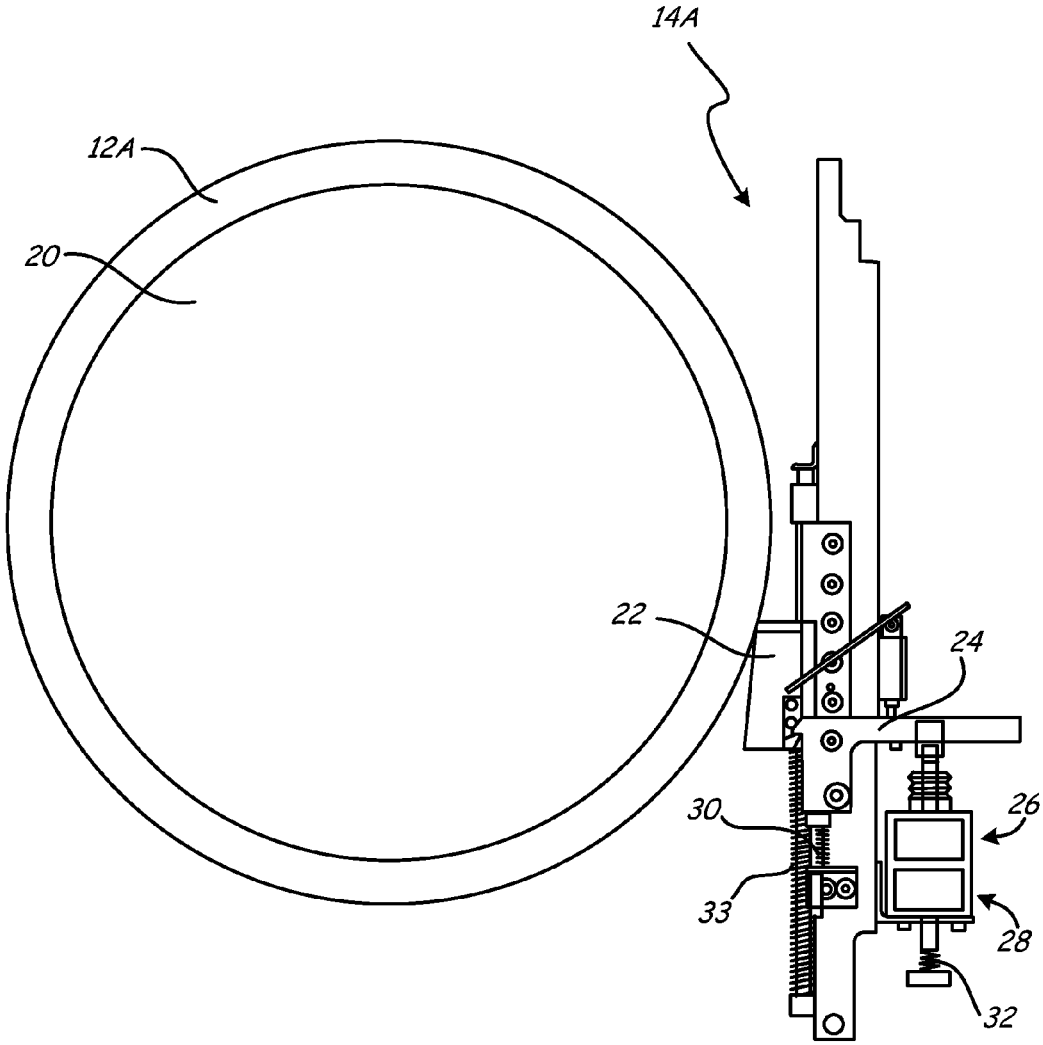
FIG. 2 is a side view of one embodiment of a main drive shaft brake.

FIG. 2 is a side view of one embodiment of main drive shaft brake 14A. Depicted in FIG. 2 are drive sheave 12A, main drive shaft brake 14A, brake disk 20, brake wedge 22, release lever 24, release solenoid 26, line solenoid 28, first spring 30, second spring 32, and third spring 33. Main drive shaft brake 14A is a dual solenoid electromechanical system configured to stop passenger conveyor 10 during abnormal conditions.

Brake disk 20 is mounted to main drive shaft sheave 12A. Located on one side of brake disk 20 and drive sheave 12A, is main drive shaft brake 14A including brake wedge 22, release lever 24, release solenoid 26, line solenoid 28, and springs 30, 32, 33. Brake wedge 22 has a first side adjacent to drive sheave 12A and a second side connected to release lever 24. Release lever 24 has a pivoting base near drive sheave 12A and brake wedge 22, and an arm extending away from its base to connect with release solenoid 26. Release solenoid 26 is beneath the arm of release lever 24 and above line solenoid 28. Release solenoid 26 and line solenoid 28 are connected to each other and can share a common solenoid housing, although other configurations are contemplated. First spring 30 is connected to the base of release lever 24, second spring 32 is connected to a bottom of line solenoid 28, and third spring 33 is connected to a bottom of brake wedge 22 where it is adjacent to first spring 30.

Main drive shaft brake 14A is a spring loaded system biased toward brake release and countered by release solenoid 26. First spring 30 is biased to pivot release lever 24 and third spring 33 is biased to thrust brake wedge 22 into interference with drive sheave 12A. Release lever 24 has a latch which engages brake wedge 22 thereby holding brake wedge 22 in a lifted or "ready to brake" position. With brake wedge 22 held out of the way, drive sheave 12A is free to rotate and engage step chain 16 (not depicted). Release lever 24 is held horizontally in the lifted position by release solenoid 26. Power supplied to release solenoid 26 keeps release lever 24 horizontal, which keeps brake wedge 22 in the lifted position. As will be described in more detail below with reference to FIGS. 3 and 4, when an emergency or otherwise abnormal condition occurs and actuation of main drive shaft brake 14 is desired, power to release solenoid 26 is intentionally interrupted. Without power, release solenoid 26 no longer holds release lever 24 in the horizontal position and therefore, first spring 30 pivots release lever 24. Once release lever 24 pivots, it is no longer holding brake wedge 22 out of the way of drive sheave 12A. Third spring 33 thrusts brake wedge 22 into engagement with drive sheave 12A, thereby halting movement of the step chain 16 of passenger conveyor 10.

In prior art systems, both an intentional loss of power due to an abnormal condition and an unintentional loss of power due to power failure would cut off power to release solenoid 26 and therefore, cause release lever 24 to drop brake wedge 22. The unintentional actuation of main drive shaft brake system 14A is undesirable. The addition of line solenoid 28 and second spring 32 in the present invention allows main drive shaft brake system 14A to operate normally when cessation of power to release solenoid 26 is intentional, but inhibits the unintentional release of release lever 24. In the case of an unintentional loss of power such as a power outage or power interruption, line solenoid 28, biased by second spring 32, will prevent release solenoid 26 from disengaging release lever 24. Details of the interaction between release solenoid 26 and line solenoid 28 are described below with reference to FIGS. 3-5.

Figure 3:
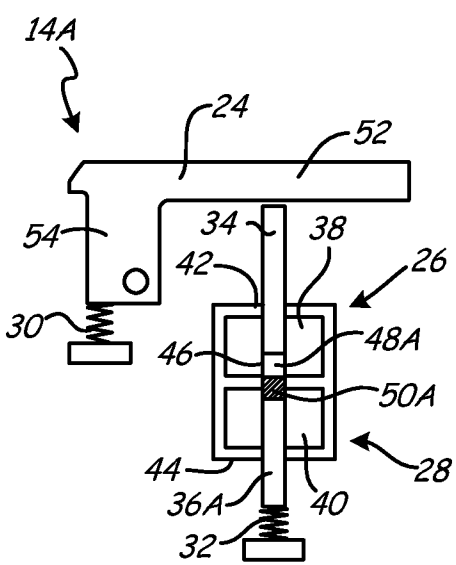
FIG. 3 is a cross-sectional view of the embodiment of the main drive shaft brake from FIG. 2 in a ready to brake or lifted position.

FIG. 3 is a cross-sectional view of main drive shaft brake system 14A in a ready to brake position. Depicted are the components of main drive shaft brake system 14A: release lever 24, release solenoid 26, line solenoid 28, first spring 30, second spring 32, first stroke or plunger 34, second stroke or plunger 36A, first coil 38, second coil 40, first side 42, second side 44, aperture 46, space 48A, buffer 50A, arm 52, and base 54. In FIG. 3, the bias of first spring 30 is countered by electromagnetism from release solenoid 26 holding main drive shaft brake 14A in the ready to brake position illustrated.

Extending between release lever 24 and release solenoid 26 is first stroke 34. Opposite to release solenoid 26 and first stroke 34, and creating a mirror image thereof, are line solenoid 28 and second stroke 36A. First stroke 34 is adjacent release lever 24 and extends into first coil 38. Second stroke 36A extends from second spring 32 into second coil 40. First coil 38 and second coil 40 are adjacent to one another thereby connecting release solenoid 26 to line solenoid 28. First stroke 34 enters first coil 38 on first side 42 and second stroke 36 enters second coil 40 on second side 44, such that both first stroke 34 and second stroke 36 extend into aperture 46 running though a center of first coil 38 and second coil 40. In an approximate center of aperture 46 is space 48A. Buffer 50A is attached to second stroke 36A adjacent to space 48A. Buffer 50A comprises a non-magnetic material, such as but not limited to, plastic. Release lever 24 has arm 52 extending from one side of base 54, where arm 52 is located above and adjacent to first stroke 34 and base 54 is attached to first spring 30.

In FIG. 3, power is independently supplied to both first coil 38 of release solenoid 26 and second coil 40 of line solenoid 28. Power received by first coil 38 is used to pull first stroke 34 outward and away from line solenoid 28. Similarly, power received by second coil 40 is used to pull second stroke 36A outward and away from release solenoid 26. Energizing release solenoid 26 and line solenoid 28 frees up space 48A of aperture 46, thereby bringing main drive shaft brake system 14A into the ready to brake position. The electromagnetic force of first coil 38 pulls first stroke 34 upwardly through first side 42 to hold arm 52 in a horizontal and approximately perpendicular position. When arm 52 is held in this perpendicular position, spring forces of first spring 30 and of third spring 33 are countered. In a similar fashion, the electromagnetic force of second coil 40 pulls second stroke 36A downwardly through second side 44 toward second spring 32 to counter spring force of second spring 32. In this lifted position, both release solenoid 26 and line solenoid 28 are energized and ready to change states should the power supply be interrupted.

Figure 4:
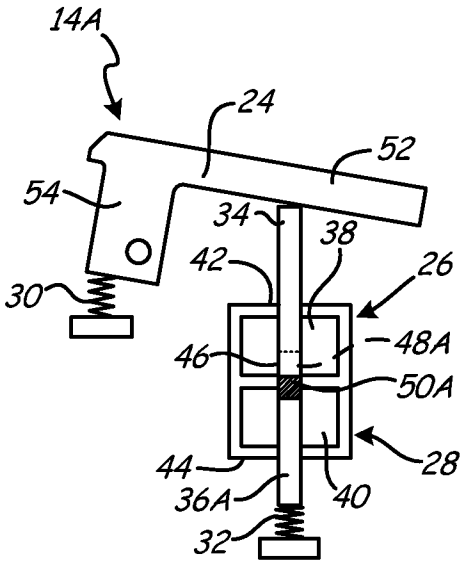
FIG. 4 is a cross-sectional view of the embodiment of the main drive shaft brake from FIG. 3 in a released or dropped position.

FIG. 4 is a cross-sectional view of main drive shaft brake system 14A in a brake released or dropped position. Depicted are the components of main drive shaft brake system 14A: release lever 24, release solenoid 26, line solenoid 28, first spring 30, second spring 32, first stroke 34, second stroke 36A, first coil 38, second coil 40, first side 42, second side 44, aperture 46, space 48A, buffer 50A, arm 52, and base 54. The components of main drive shaft brake system 14A depicted in FIG. 4 are connected as described above with reference to FIG. 3. Main drive shaft brake system 14A is an active system where power supplied to first coil 38 of release solenoid 26 counters first spring 30 and third spring 33 to keep brake wedge 22 lifted. In FIG. 4, power to first coil 38 of release solenoid 26 is interrupted so that first spring 30 pivots release lever 24, freeing third spring 33 to thrust brake wedge 22 into interference with drive sheave 12A.

When it is desirable to stop the operation of passenger conveyor 10, the power supplied to first coil 38 of release solenoid 26 is intentionally terminated. Termination of power to first coil 38 extinguishes the electromagnetic counterforce and therefore, allows first stroke 34 to fall further into aperture 46 toward line solenoid 28 where it occupies space 48A. More or less simultaneously, first spring 30 pushes base 54 upward, which causes lever 24 to pivot and arm 52 to move downwardly out of its horizontal and perpendicular alignment. This in turn allows third spring 33 to apply its bias to brake wedge 22. When release solenoid 26 is intentionally de-energized to apply main drive shaft brake system 14A, power continues to be supplied to second coil 40 of line solenoid 28. Thus, application of brake wedge 22 is dependent on termination of power to release solenoid 26 and the continuation of power to line solenoid 28. Main drive shaft brake system 14A, including the dropping of brake wedge 22 by release lever 24, is resettable. When release solenoid 26 is energized once again, first coil 38 pushes first stroke 34 upwards so that arm 52 is perpendicular to first stroke 34, brake wedge 22 is lifted and main drive shaft brake system 14A is ready to brake again.

Figure 5:
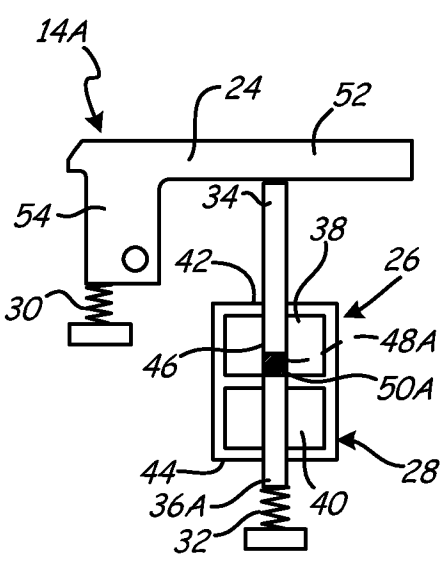
FIG. 5 is a cross-sectional view of the embodiment of the main drive shaft brake from FIGS. 3 and 4 in a brake blocked or inhibited position.

FIG. 5 is a cross-sectional view of main drive shaft brake system 14A in a brake blocked position. Depicted are the components of main drive shaft brake system 14A: release lever 24, release solenoid 26, line solenoid 28, first spring 30, second spring 32, first stroke 34, second stroke 36A, first coil 38, second coil 40, first side 42, second side 44, aperture 46, space 48A, buffer 50A, arm 52, and base 54. The components of main drive shaft brake system 14A depicted in FIG. 5 are connected as described above with reference to FIG. 3. Main drive shaft brake system 14A is equipped with line solenoid 28 to prevent an unintentional release of release solenoid 26. In FIG. 5, an approximately simultaneous interruption or loss of power to both release solenoid 26 and line solenoid 28 causes second spring 32 and second stroke 36A to inhibit the movement of release lever 24 caused by the release of first stroke 34 into space 48A of aperture 46.

In the case of power failure, power is unintentionally terminated to both release solenoid 26 and line solenoid 28. In prior art systems that lack line solenoid 28, a power failure mimics an intentional termination of power in that release solenoid 26 is de-energized, which drops release lever 24, allowing brake wedge 22 to stop rotation of drive sheave 12A and operation of passenger conveyor 10. In main drive shaft brake system 14A, an approximately simultaneous loss of power to both release solenoid 26 and line solenoid 28 extinguishes the electromagnetic counterforce of both first coil 38 and second coil 40. First stroke 34 is no longer prevented by first coil 38 from falling into aperture 46. Second stroke 36A, however, moves into space 48A more quickly and more forcefully than first stroke 34. More specifically, the bias of second spring 32 pushes second stroke 36A upwardly into aperture 46 toward release solenoid 26. Buffer 50A of second stroke 36A occupies space 48A and prevents first stroke 34 from occupying space 48A. As a result, release lever 24 stays in its lifted position where arm 52 is substantially perpendicular to first stroke 34 and base 54 continues to latch brake wedge 22. Space 48A is dimensioned so that either first stroke 34 or buffer 50A on second stroke 36A can occupy space 48A, but not both. The bias of second spring 32 is greater than that of first spring 30, so that second stroke 36A will block and inhibit the movement of first stroke 34 in the case of power failure. Second stroke 36A will have a faster reaction time than first stroke 34 so that second stroke 36A will always beat first stroke 34 by occupying space 48A first. Line solenoid 28, therefore, comprises a fail safe system that prevents the unintentional dropping of release lever 24 and application of brake wedge 22.

Figure 6:
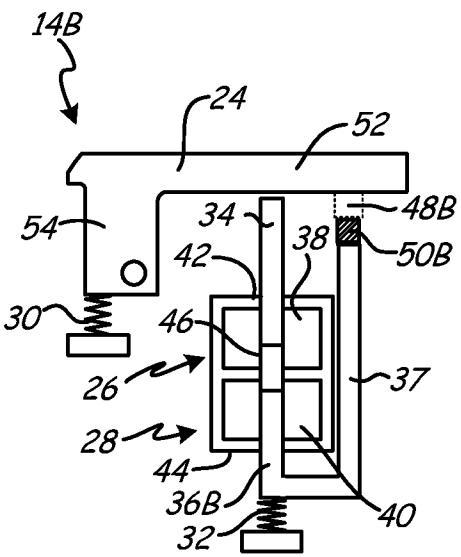
FIG. 6 is a cross-sectional view of an alternative embodiment of a main drive shaft brake in a ready to brake or lifted position.

FIG. 6 is a cross-sectional view of an alternative embodiment of main drive shaft brake 14B in a ready to brake or lifted position. Depicted are the components of main drive shaft brake 14B: release lever 24, release solenoid 26, line solenoid 28, first spring 30, second spring 32, first stroke or plunger 34, second stroke or plunger 36B, stroke extension 37, first coil 38, second coil 40, first side 42, second side 44, aperture 46, space 48B, buffer 50B, arm 52, and base 54. The components of main drive shaft brake 14B are arranged and functioning similar to the components of main drive shaft brake 14A described above. In fact, FIGS. 6-9 are in large part explained by the above description of FIGS. 3-5 where like numbers correspond to like components. In the interest of brevity, the differences between main drive shaft brake 14B and main drive shaft brake 14A will be highlighted below.

The structural differences of main drive shaft brake 14B are best understood from second stroke 36B having stroke extension 37 and the location of space 48B and buffer 50B. In main drive shaft brake 14B shown in FIG. 6, stroke extension 37 has a reverse "L"-shape, first extending horizontally from one end of second stroke 36B away from second coil 40 and then extending vertically in the direction of arm 52 and substantially parallel to second stroke 36B, adjacent an outside of both line solenoid 28 and release solenoid 26. Stroke extension 37 is substantially parallel to and spaced apart from first stroke 34 as it approaches a bottom surface of arm 52. Located at a top of stroke extension 37, adjacent a bottom surface of arm 52, is buffer 50B. Like buffer 50A, buffer 50B comprises a non-magnetic material such as but not limited to plastic. Located between buffer 50B and the bottom surface of arm 52 is space 48B. Space 48B is dimensioned such that either buffer 50B or a portion of arm 52 can occupy space 48B, but not both.

The functional differences of main drive shaft brake 14B arise from the location of space 48B and buffer 50B. Energizing release solenoid 26 and line solenoid 28 brings main drive shaft brake system 14B into the ready to brake position. The electromagnetic force of second coil 40 pulls second stroke 36B downwardly through second side 44 toward second spring 32 to counter spring force of second spring 32. By pushing second stroke 36B downwardly, stroke extension 37 and attached buffer 50B are also held down thereby, freeing up space 48B between buffer 50B and arm 52. In this lifted position, both release solenoid 26 and line solenoid 28 are energized and ready to change states should the power supply be interrupted.

Figure 7:
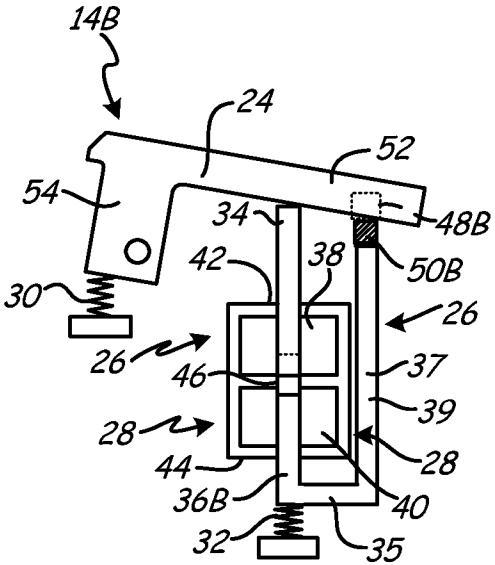
FIG. 7 is a cross-sectional view of the embodiment of the main drive shaft brake from FIG. 6 in a released or dropped position.

FIG. 7 is a cross-sectional view of the embodiment of main drive shaft brake 14B from FIG. 6 in a released or dropped position. Depicted are the components of main drive shaft brake system 14B: release lever 24, release solenoid 26, line solenoid 28, first spring 30, second spring 32, first stroke 34, second stroke 36B, stroke extension 37, first coil 38, second coil 40, first side 42, second side 44, aperture 46, space 48B, buffer 50B, arm 52, and base 54. The components of main drive shaft brake system 14B depicted in FIG. 7 are connected as described above with reference to FIGS. 3 and 6.

Termination of power to first coil 38 extinguishes the electromagnetic counterforce and therefore, allows first stroke 34 to fall further into aperture 46 toward line solenoid 28. More or less simultaneously, first spring 30 pushes arm 52 downwardly out of its horizontal and perpendicular alignment and into space 48B to contact buffer 50B. More or less simultaneously, first spring 30 pushes base 54 upward, which causes lever 24 to pivot and arm 52 to move downwardly out of its horizontal and perpendicular alignment. This in turn allows third spring 33 to apply its bias to brake wedge 22. When release solenoid 26 is intentionally de-energized to apply main drive shaft brake system 14B, power continues to be supplied to the second coil 40 of line solenoid 28. Thus, as in main drive shaft brake system 14A shown in FIG. 4, application of brake wedge 22 is dependent on termination of power to release solenoid 26 and the continuation of power to line solenoid 28. Main drive shaft brake system 14B is also resettable. When release solenoid 26 is energized once again, first coil 38 pushes first stroke 34 upwards so that arm 52 is perpendicular to first stroke 34 and no longer occupying space 48B. So positioned, main drive shaft brake system 14B is once again ready to brake and holds brake wedge 22 in the lifted and ready position.

Figure 8:
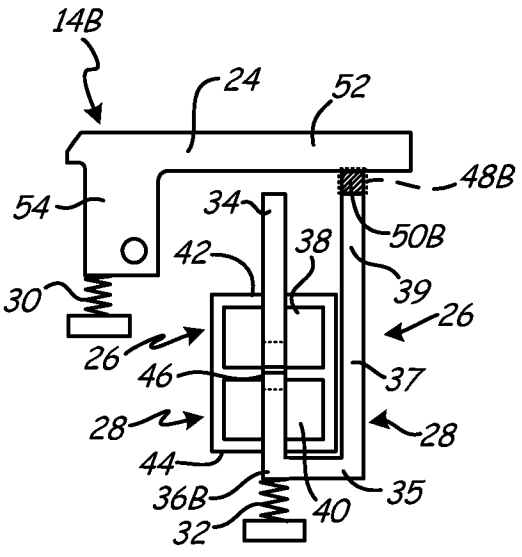
FIG. 8 is a cross-sectional view of the embodiment of the main drive shaft brake from FIGS. 6 and 7 in a brake blocked or inhibited position.

FIG. 8 is a cross-sectional view of the embodiment of main drive shaft brake 14B from FIGS. 6 and 7 in a brake blocked or inhibited position. Depicted are the components of main drive shaft brake system 14B: release lever 24, release solenoid 26, line solenoid 28, first spring 30, second spring 32, first stroke 34, second stroke 36B, stroke extension 37, first coil 38, second coil 40, first side 42, second side 44, aperture 46, space 48B, buffer 50B, arm 52, and base 54. The components of main drive shaft brake system 14B depicted in FIG. 8 are connected as described above with reference to FIGS. 3 and 6.

In main drive shaft brake system 14B, an approximately simultaneous loss of power to both release solenoid 26 and line solenoid 28 extinguishes the electromagnetic counterforce of both first coil 38 and second coil 40, and first stroke 34 is no longer prevented by first coil 38 from moving further into aperture 46. Buffer 50B attached to stroke extension 37, however, moves into space 48B and prevents arm 52 from occupying space 48B. More specifically, the bias of second spring 32 pushes second stroke 36B, including stroke extension 37 having buffer 50B attached thereto, upwardly. Since arm 52 is prevented from falling into space 48B, now occupied by buffer 50B, lever 24 continues to latch brake wedge 22 and hold it in a lifted position. The bias of second spring 32 is greater than that of first spring 30, so that second stroke 36B will block and inhibit the movement of lever arm 52 in the case of power failure. Second stroke 36B will have a faster reaction time than first spring 30 or lever 24, so that second stroke 36B will always beat release lever 24 by occupying space 48B first. Line solenoid 28, therefore, comprises a fail safe system that prevents the unintentional dropping of release lever 24 and application of brake wedge 22.

Although the present invention has been described with reference to preferred embodiments, workers skilled in the art will recognize that changes may be made in form and detail without departing from the spirit and scope of the invention.

The invention claimed is:

1. A main drive shaft brake for a passenger conveyor, the brake comprising:

a braking element for halting movement of a driving mechanism in the passenger conveyor system;

an actuator connected to the braking element for controlling activation of the braking element, the actuator movable between an energized mode, in which power supplied to the actuator keeps the braking element in a ready position, and an un-energized mode, in which a lack of power supplied to the actuator causes the actuator to release the braking element, thereby halting movement of the driving mechanism in the passenger conveyor system; and a counter-actuator connected to the actuator, the counter-actuator movable between an energized mode in which power supplied to the counter-actuator keeps the counter-actuator from interfering with the actuator, and an un-energized mode, in which a lack of power causes the counter-actuator to block the release of the braking element.

2. The brake of claim 1, wherein the passenger conveyor system is an escalator or a moving walkway.

3. The brake of claim 1, wherein the actuator and counter-actuator comprise a first solenoid and a second solenoid, respectively.

4. The brake of claim 3, wherein the actuator and the counter-actuator further comprise a first coil and a second coil, respectively.

5. The brake of claim 4, wherein the counter-actuator comprises a non-magnetic buffer that blocks the release of the braking element by the actuator.

6. The brake of claim 1, wherein the brake is resettable after the braking element is released.

7. A main drive shaft brake for a passenger conveyor, the brake comprising:

a braking element;

a release lever connected to the braking element for holding the braking element in a lifted and ready position or releasing the braking element to halt movement of the conveyor, an actuator having a first coil adjacent to the release lever and a first stroke extending into the first coil, the first stroke capable of moving further into the first coil to enable the release lever to release the braking element; and a counter-actuator opposite to the actuator, the counter-actuator having a second coil and a second stroke extending into the second coil, the second stroke being biased by a spring such that a loss of power causes the second stroke to block the first stroke from moving further into the first coil, thereby preventing release of the braking element.

8. The brake of claim 7, wherein second stroke includes a buffer end opposite the spring such that a loss of power causes the buffer end of the second stroke to block the first stroke.

9. The brake of claim 8, wherein the buffer end comprises a non-magnetic material.

10. The brake of claim 7, wherein power supplied to the first coil causes the first stroke to move away from the second coil.

11. The brake of claim 10, wherein power supplied to the second coil causes the second stroke to move away from the first coil.

12. The brake of claim 7, wherein a space between the first coil and the second coil is dimensioned such that only one of the first stroke and the second stroke can occupy the space at any given time.

13. The brake of claim 7, wherein the release lever comprises a base and an arm extending from one side of the base, the base being connected to a release spring and the braking element, the arm being connected to the actuator.

14. The brake of claim 7, wherein the braking element is a wedge brake.

15. The brake of claim 7, wherein the actuator comprises a release solenoid and the counter-actuator comprises a line solenoid.

16. The brake of claim 7, wherein the passenger conveyor is an escalator or a moving walkway.

17. A method of controlling a main drive shaft brake for a passenger conveyor, the method comprising:

controlling an electrically controlled brake actuator in either an energized state, such that the brake actuator holds the main drive shaft brake in lifted position, or a de-energized state to cause the brake actuator to release the main drive shaft brake to a dropped position; and inhibiting the brake actuator from releasing the main drive shaft brake in response to a loss of line power.

18. The method of claim 17, wherein the step of inhibiting the brake actuator comprises:

maintaining a counter-actuator in an energized state such that it is only de-energized in response to a loss of line power.

19. The method of claim 18, wherein a loss of line power causes the brake actuator and the counter-actuator to de-energize approximately simultaneously, and wherein the counter-actuator inhibits the brake actuator from releasing the main drive shaft brake.

20. The method of claim 19, further comprising:

resetting the main drive shaft brake and brake actuator by re-energizing the actuator.

21. A passenger conveyor comprising:

a driving mechanism;

a drive sheave in contact with the driving mechanism for imparting motion thereto; and a main drive shaft brake associated with the drive sheave, the main drive shaft brake including a braking element for halting rotation of the drive sheave, an actuator for controlling activation of the braking element, and a counter-actuator for blocking an unintentional activation of the braking element.

22. The passenger conveyor of claim 21, wherein the actuator is movable between an energized mode, in which power supplied to the actuator keeps the braking element in a ready position, and an un-energized mode, in which a lack of power supplied to the actuator causes the actuator to release the braking element, thereby halting movement of the driving mechanism in the passenger conveyor system.

23. The passenger conveyor of claim 22, wherein the counter-actuator is movable between an energized mode in which power supplied to the counter-actuator keeps the counteractuator from interfering with the actuator, and an un-energized mode, in which a lack of power causes the counter-actuator to block the release of the braking element.

24. The passenger conveyor of claim 21 wherein the counter-actuator inhibits activation of the braking element in response to a loss of line power.

* * * * *